US008355642B2

(12) United States Patent
Shoji et al.

(10) Patent No.: US 8,355,642 B2
(45) **Date of Patent: *Jan. 15, 2013**

(54) IMAGE FORMING APPARATUS WHICH CONTINUES TO CONVEY A SHEET IF THE SHEET IS ONLY SLIGHTLY DELAYED

(75) Inventors: Yutaka Shoji, Ibaraki (JP); Junji Shirakawa, Ibaraki (JP); Takayuki Muneyasu, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 509 days.

This patent is subject to a terminal disclaimer.

(21) Appl. No.: 12/481,096

(22) Filed: Jun. 9, 2009

(65) Prior Publication Data

US 2009/0310983 A1 Dec. 17, 2009

(30) Foreign Application Priority Data

Jun. 16, 2008 (JP) ..... 2008-157007
Sep. 5, 2008 (JP) ..... 2008-227989

(51) Int. Cl.
*G03G 15/00* (2006.01)

(52) U.S. Cl. ..... 399/20; 399/21; 399/23; 399/405

(58) Field of Classification Search ..... 399/19, 399/20, 21, 23, 405

See application file for complete search history.

(56) References Cited

U.S. PATENT DOCUMENTS 5,713,060 A 1/1998 Sato et al.

FOREIGN PATENT DOCUMENTS

| | | |
|---|---|---|
| JP | 56-8163 | 1/1981 |
| JP | 7-206218 | 8/1995 |
| JP | 07261608 | * 10/1995 |
| JP | 08301483 | * 11/1996 |
| JP | 09124185 | * 5/1997 |
| JP | 2779826 | 5/1998 |
| JP | 2002-268304 | 9/2002 |

OTHER PUBLICATIONS

Chinese Office Action issued Jan. 31, 2011, in Patent Application No. 200910140673.6 (with English-language translation).

* cited by examiner

*Primary Examiner* — Judy Nguyen
*Assistant Examiner* — Blake A Tankersley
(74) *Attorney, Agent, or Firm* — Oblon, Spivak, McClelland, Maier & Neustadt, L.L.P.

(57) ABSTRACT

Disclosed is an image forming apparatus that includes a recording medium feeding unit that feeds a recording medium to a predetermined conveyance path; a conveyance unit that conveys the recording medium fed from the recording medium feeding unit on the conveyance path; a conveyance status detection unit that detects a conveyance status of the recording medium placed on the conveyance path; a control unit that controls operations of the recording medium feeding unit, the conveyance unit, and the conveyance status detection unit; and an accommodation unit that accommodates the recording medium. The control unit controls the feeding of the recording medium with the recording medium feeding unit and the conveyance of the recording medium with the conveyance unit based on a detection result of the conveyance status detection unit, thereby discharging the recording medium present in the image forming apparatus to the accommodation unit.

8 Claims, 10 Drawing Sheets

DETECT CONVEYANCE FAILURE

CONTROL DRIVING OF CONVEYANCE UNIT 204

CONTROL DRIVING OF SHEET FEEDING UNIT 203

DETECT ABSENCE OF SHEET WITH SENSOR 125

CONTROL SWITCHING OF SWITCHING CLAW 125
DISCHARGE ALL THE SHEETS ON CONVEYANCE PATH A

IMAGE FORMING APPARATUS WHICH CONTINUES TO CONVEY A SHEET IF THE SHEET IS ONLY SLIGHTLY DELAYED

BACKGROUND OF THE INVENTION

1. Field of the Invention

The present invention relates to an image forming apparatus that continues the conveyance of a recording sheet without stopping the apparatus even if there is a failure in the conveyance of the recording sheet and then discharges the recording sheet remaining in the apparatus, thereby making it possible to implement a printing operation in a short period of time.

2. Description of the Related Art

In general, a known copier has, for example, an annular sheet conveyance path for double-sided printing. In such a copier, if a conveyance failure occurs along on the sheet conveyance path, it is necessary to temporarily stop the image forming apparatus and remove all the recording sheets circulating in the apparatus.

In the copier described in Patent Document 1, a recording sheet having been subjected to double-sided printing is specified from among those remaining in the apparatus when jamming occurs and then discharged if the recording sheet is determined not to be a jammed sheet. In other words, when jamming occurs along on a conveyance path in the copier described in Patent Document 1 that performs double-sided printing while circulating plural of the recording sheets on the conveyance path, a recording sheet to be discharged is determined based on the discharge destination information of the recording sheet (i.e., information indicating whether the recording sheet is to be discharged outside the apparatus or conveyed to an inversion path) and the positional information of the recording sheet on the conveyance path. That is, when it is determined that jamming is not caused based on the jamming information on the recording sheet, the recording sheet is discharged outside the apparatus. Thus, the unnecessary use of the available recording sheet having been subjected to printing can be prevented.

Furthermore, in a recording apparatus described in Patent Document 2, a determination is made as to whether a recording sheet is deflected or skewed on a conveyance path. When the determination result does not fall within a specified range, the recording sheet is guided in a direction different from a normal sheet feeding/discharging direction and removed from the conveyance path, thereby reducing the occurrence of jamming.

Patent Document 1: JP-A-2002-268304

Patent Document 2: JP-A-56-8163

However, Patent Document 1 only describes that an available recording sheet determined not to be a jammed sheet is discharged even if jamming occurs for the purpose of preventing the unnecessary use of the available recording sheet having been properly subjected to printing.

Furthermore, Patent Document 2 only describes that a deflected or skewed recording sheet is immediately removed from the conveyance path for the purpose of preventing the occurrence of jamming on the conveyance path for the recording sheet.

On the other hand, the user, who performs large amounts of printing such as printing of 90 sheets per minute, not only requests for a high printing speed but also wishes to perform a restoration process in the shortest time possible when an apparatus is stopped due to a failure in the conveyance of a recording sheet.

SUMMARY OF THE INVENTION

In light of the above circumstances, the present invention may provide an image forming apparatus that continues the conveyance of a recording sheet as if the recording sheet were properly conveyed without stopping the apparatus if a detected failure in the conveyance of the recording sheet is minor and then discharges the recording sheet remaining in the apparatus, thereby facilitating a restoration process for the apparatus and making it possible to implement a series of printing operations in a short period of time as a whole.

To this end, according to an aspect of the present invention, there is provided an image forming apparatus including a recording medium feeding unit that feeds a recording medium to a predetermined conveyance path; a conveyance unit that conveys the recording medium fed from the recording medium feeding unit on the conveyance path; a conveyance status detection unit that detects a conveyance status of the recording medium placed on the conveyance path; a control unit that controls operations of the recording medium feeding unit, the conveyance unit, and the conveyance status detection unit; and an accommodation unit that accommodates the recording medium. The control unit controls the feeding of the recording medium with the recording medium feeding unit and the conveyance of the recording medium with the conveyance unit based on a detection result of the conveyance status detection unit, thereby discharging the recording medium present in the image forming apparatus to the accommodation unit.

Other objects, features and advantages of the present invention will become more apparent from the following detailed description when read in conjunction with the accompanying drawings.

DETAILED DESCRIPTION OF THE PREFERRED EMBODIMENTS

Hereinafter, an embodiment of the present invention is described with reference to the accompanying drawings.

Figure 1:
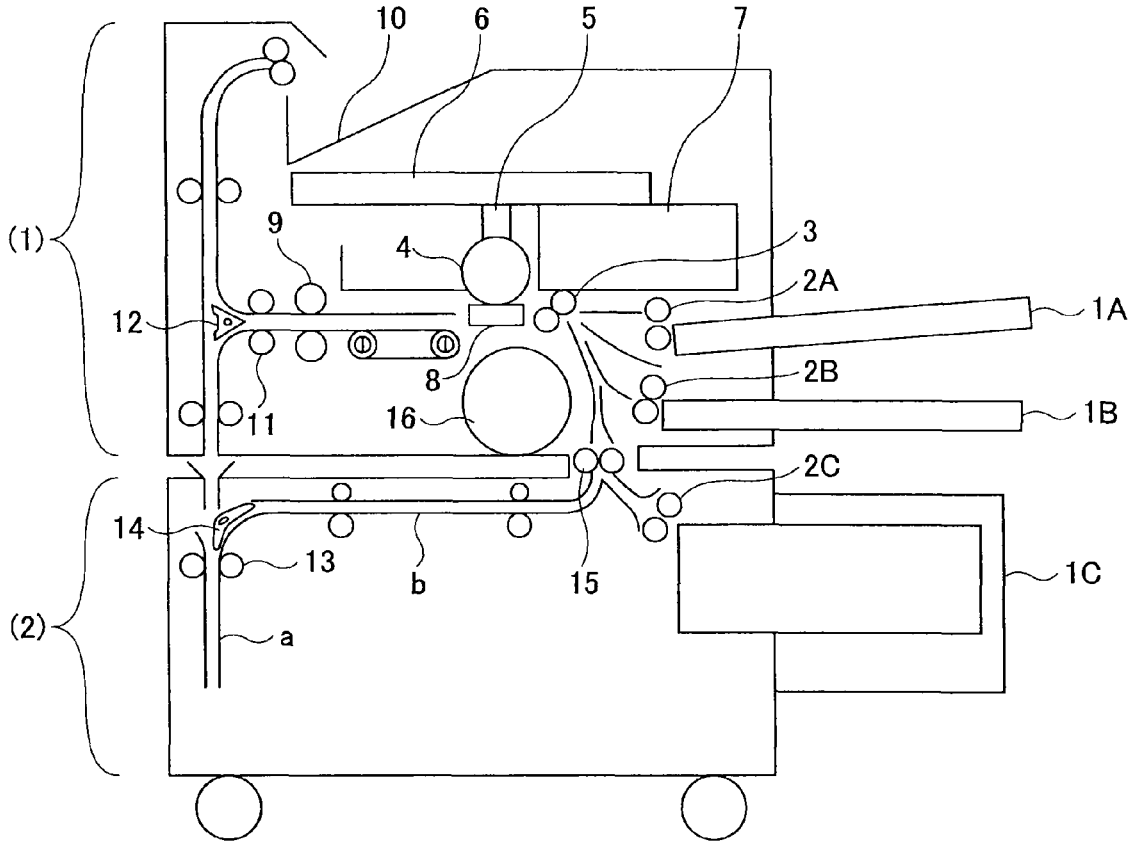
FIG. 1 shows an image forming apparatus (laser printer) as an example to which an embodiment of the present invention is applied.

FIG. 1 shows an image forming apparatus (laser printer) as an example to which the embodiment of the present invention is applied. In the image forming apparatus, an image forming apparatus main body 1 and a double-sided printing apparatus 2 are integrated with each other. In FIG. 1, reference numerals 1A through 1C denote sheet feeding trays. Reference numerals 2A through 2C denote sheet feeding rollers, reference numeral 3 denotes a resist roller, reference numeral 4 denotes a photosensitive body, reference numeral 5 denotes an electrification charger, reference numeral 6 denotes an optical unit, reference numeral 7 denotes a development unit, reference numeral 8 denotes a transfer charger, reference numeral 9 denotes a fixation unit, reference numeral 10 denotes a sheet receiving tray, reference numeral 11 denotes a sheet discharging roller, reference numeral 12 denotes a switching claw, reference numeral 13 denotes an inversion roller, reference numeral 14 denotes an inversion claw, reference numeral 15 denotes a sheet feeding roller, and reference numeral 16 denotes a main motor.

In the image forming apparatus shown in FIG. 1, an image is formed in a general electrophotographic process. In other words, a recording sheet fed from the sheet feeding trays 1A, 1B, and 1C is conveyed to the photosensitive body 4 with the sheet feeding rollers 2A, 2B, and 2C and the resist rollers 3. Then, the recording sheet is subjected to image formation processes such as charging, exposure, development, and fixation with the electrification charger 5, the optical unit 6, the development unit 7, the transfer charger 8, the fixation unit 9, etc. In this manner, an image is formed on the recording sheet. The above respective units for the image formation processes are driven with the main motor 16. The recording sheet from the fixation unit 9 having been subjected to single-sided printing is directly discharged to the sheet receiving tray 10 or conveyed to the double-sided printing apparatus 2 for rear-side printing. Whether the recording sheet is discharged to the sheet receiving tray 10 or conveyed to the double-sided printing apparatus 2 is selected in accordance with the switching control of the sheet discharging rollers 11 and the switching claw 12 based on printing instructions from the user. When the recording sheet is conveyed to the double-sided printing apparatus 2, it is conveyed to a conveyance path a on the side of the inversion rollers 13 with the control of the switching claw 12. Then, with the control of the inversion rollers 13 and the inversion claw 14, the recording sheet is conveyed to a conveyance path b in a switch back manner. That is, the recording sheet is conveyed to the resist rollers 3 with the sheet feeding rollers 15 in a state in which one side of the recording sheet having been subjected to printing is inverted to make the other side of the recording sheet a recording surface.

In the image forming apparatus, when a large number of recording sheets are printed at a time, the recording sheets are fed successively from the sheet feeding tray 1C storing the large number of recording sheets, so that the plural (e.g., three or four) of the recording sheets are circulated and conveyed simultaneously on an entire conveyance path. In this case, the first, the second, and the third recording sheets are successively fed from the sheet feeding tray 1C to the image forming apparatus main body 1 for front-surface printing, and then image formation is performed on the front surfaces of these recording sheets. After the image formation is performed on the front surface of the third recording sheet, the image formation is performed on the rear surface of the first recording sheet that is fed again via the double-sided printing apparatus 2. Subsequently, the image formation is performed on the front surface of the fourth recording sheet that is newly fed from the sheet feeding tray 1C. In other words, the image formation is successively performed in an order of the front surface of the first recording sheet, the front surface of the second recording sheet, the front surface of the third recording sheet, the rear surface of the first recording sheet, the front surface of the fourth recording sheet, the rear surface of the second recording sheet, etc.

In this type of the image forming apparatus, however, a failure in the conveyance of the recording sheets is inevitable. Examples of the conveyance failure include so-called "jamming" in which the recording sheet is folded like an accordion and wound about a roller, an "unreached" status in which the recording sheet does not reach a predetermined conveyance position in the image forming apparatus at predetermined timing, and an "accumulated" status in which the recording sheet is kept accumulated at a predetermined conveyance position in the image forming apparatus even after predetermined timing at which the recording sheet must be conveyed. When the jamming occurs, the image forming apparatus must be stopped immediately. In case of the unreached status and the accumulated status, however, as far as the periods of the unreached status and the accumulated status fall within a predetermined range (i.e., if the recording sheet is conveyed and detected within a predetermined period to resolve the unreached status and the accumulated status after the unreached status and the accumulated status are caused), no problem occurs in the apparatus at this point. Therefore, it is not necessary to immediately stop the image forming apparatus to remove the recording sheet by hand. Such a situation can be regarded as a minor conveyance failure.

Figure 2:
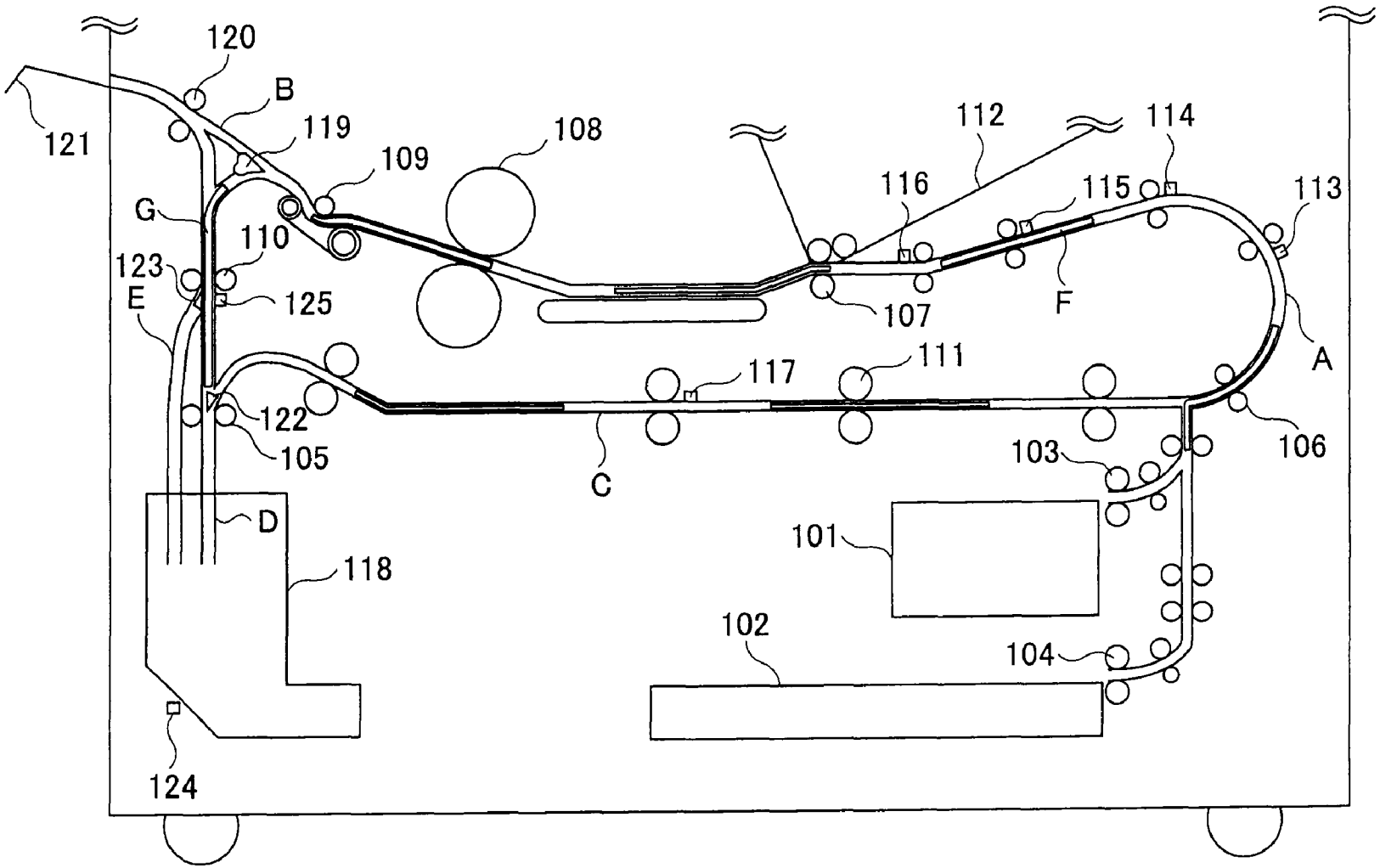
FIG. 2 shows an image forming apparatus to which the embodiment of the present invention is applied.

FIG. 2 shows an image forming apparatus to which the embodiment of the present invention is applied. In FIG. 2, reference numerals 101 and 102 denote sheet feeding trays, reference numerals 103 and 104 denote sheet feeding rollers, reference numeral 105 denotes an inversion roller, reference numeral 106 denotes a conveyance roller, reference numeral 107 denotes a transfer roller, reference numeral 108 denotes a fixation roller, reference numeral 109 denotes a conveyance roller, reference numeral 110 denotes a flip roller, reference numeral 111 denotes a conveyance roller, reference numeral 112 denotes a transfer belt, reference numerals 113 through 117 denote sensors, reference numeral 118 denotes a sheet receiving tray, reference numeral 119 denotes a switching claw, reference numeral 120 denotes a sheet discharging roller, reference numeral 121 denotes a sheet receiving tray, reference numerals 122 and 123 denote switching claws, and reference numerals 124 and 125 denote sensors. Furthermore, as a path on which the recording sheet is conveyed, character A denotes a conveyance path, character B denotes a single-sided printing path, character C denotes a double-sided printing path, character D denotes an inversion path, and character E denotes a sheet discharging path. Moreover, in order to clearly describe characteristics of the present invention, this embodiment refers to a state in which plural of the recording sheets are circulated in the image forming apparatus. In other words, FIG. 2 shows a state in which the seven recording sheets are circulated on the paths A through E. Here, for example, the recording sheet F or G is a recorded sheet.

In the image forming apparatus shown in FIG. 2, the recording sheet is fed from the sheet feeding tray 101 or 102. The fed recording sheet is then conveyed counterclockwise on the conveyance path A via a pair of the sheet feeding rollers 103 or 104, etc. Here, the conveyance path A refers to an annular path on which the fed recording sheet is subjected to front-surface printing in an image formation process, inverted with a pair of the inversion rollers 105, and conveyed again to an image forming unit for rear-surface printing. In other words, the conveyance path A is the annular path from a pair of the conveyance rollers 106 to the conveyance rollers 106 themselves via a pair of the transfer rollers 107, a pair of the fixation rollers 108, the conveyance roller 109, a pair of the flip rollers 110, a pair of the inversion rollers 105, a pair of the conveyance rollers 111, etc. Image formation is performed on the recording sheet on the conveyance path A, and an image formation system is equivalent to that of, for example, the image forming apparatus described referring to FIG. 1. That is, in the image forming apparatus shown in FIG. 2, image formation is performed through general processes such as charging, exposure, development, fixation, etc., as in the case of the image forming apparatus shown in FIG. 1. In FIG. 2, the units for charging, exposure, and development are not shown. Furthermore, the pair of the transfer rollers 107 constitute a part of the a transfer unit, and the development unit not shown transfers a visible image formed on the transfer belt 112 to the recording sheet. Furthermore, the pair of the fixation rollers 108 constitute a part of a fixation unit.

On the conveyance path A, the plural sensors 113 through 117 that detect the conveyance status of the recording sheet are provided. With these sensors, the unreached status and the accumulated status of the recording sheet are detected. For example, the transfer timing sensor 116 is used for detecting transfer timing with the transfer unit in the next process. However, when the tip end of the recording sheet to be transferred is not detected with the transfer timing sensor 116 at predetermined timing, it is determined that the recording sheet is in the unreached status. For example, the unreached status is determined in such a manner that the timing at which the tip end of the recording sheet is detected with the other sensors 115, etc., the timing at which the recording sheet is fed from the sheet feeding rollers 103, etc., and the timing at which the tip end of the recording sheet is detected with the transfer timing sensor 116 are managed for a predetermined period. Furthermore, when the rear end of the recording sheet is not detected even at predetermined timing after the tip end of the recording sheet has been detected (i.e., when the presence of the recording sheet is detected even at timing at which no recording sheet should be detected with the sensor 116 after the recording sheet has passed the sensor 116), it is determined that the recording sheet is in the accumulated status.

When it is determined that the recording sheet is in the unreached status or the accumulated status, the feeding of the recording sheet from the sheet feeding trays 101 and 102 is stopped, while the driving of the rollers of a conveyance system (e.g., the rollers 105 through 111, etc.) is continued for a predetermined period so that all the recording sheets on the conveyance path A are discharged to the sheet receiving tray 118. The details of the unreached status and the accumulated status and those of the operations of the image forming apparatus when the unreached status and the accumulated status are caused are described below. Note that the installation place, the shape, etc., of the tray 118 to which the recording sheet is discharged are not limited to those described in the embodiment of the present invention and may be appropriately modified so long as they fall within the scope of the embodiment of the present invention.

The recording sheet having been subjected to fixation with the fixation units 108 is conveyed to either the single-sided printing path B or the double-sided printing path C. Here, the single-sided printing path B refers to a path from the conveyance roller 109 to the conveyance rollers 120. On the other hand, the double-sided printing path C refers to a path from the conveyance roller 109 to the conveyance rollers 111 via the flip rollers 110 and the inversion rollers 105. Note that when the recording sheet is conveyed on the double-sided printing path C, it is caused to move reversely in a switch back manner with the inversion rollers 105. The switching between the single-sided printing path B and the double-sided printing path C is made in accordance with the control of the switching claw 119. When single-sided printing is instructed by the user, the recording sheet is discharged to the sheet receiving tray 121 with the sheet discharging rollers 120 via the single-sided printing path B. Furthermore, when the recording sheet is inverted and discharged for the convenience of the user who wishes to remove the discharged recording sheet even in the case of single-sided printing, the recording sheet is caused to move reversely in a switch back manner with the inversion rollers 105 after passing through the inversion path D (the path from the conveyance roller 109 to the inversion rollers 105 via the flip rollers 110) and then discharged to the sheet receiving tray 121 via the flip rollers 110 again. On the other hand, when double-sided printing is instructed by the user, the recording sheet is conveyed to the inversion path D, caused to move reversely in a switch back manner with the inversion rollers 105, and conveyed to the double-sided printing path C. That is, the recording sheet is fed again in the direction of the image forming apparatus for rear-surface printing. Whether the recording sheet caused to move reversely in a switch back manner with the inversion rollers 105 is returned to either the side of the flip rollers 110 or the side of the double-sided printing path C is switched in accordance with the control of the switching claw 122.

The sheet receiving tray 118 provided below the inversion rollers 105 is opened so as to cover at least a discharge port from the sheet discharging path E and a discharge port from the inversion path D via the inversion rollers 105. The sheet discharging path E is a path from the flip rollers 110 to the sheet discharging tray 118 that is formed in accordance with the control of the switching claw 123. With this configuration, it is possible to discharge the recording sheet from both the sheet discharging path E and the inversion path D. When the recording sheet is discharged from the sheet discharging path E, the recording sheet guided to the sheet discharging path E with the switching claw 123 naturally falls to be accommodated in the sheet receiving tray 118. Furthermore, without the provision of the switching claw 123 and the sheet discharging path E, the recording sheet may be caused to pass through the inversion rollers 105 to be directly guided to the sheet receiving tray 118 via the inversion path D. In this case, the inversion path D can also serve as a sheet discharging path, and the recording sheet is accommodated in the sheet receiving tray 118 in accordance with a driving force generated when the inversion rollers 105 are controlled.

Note that the sheet receiving tray 118 is provided with the recording sheet detection sensor 124. The recording sheet detection sensor 124 is used for detecting whether the recording sheet is present in the sheet receiving tray 118. That is, when the recording sheet detection sensor 124 detects the presence of the recording sheet, it informs the user of the fact. The presence of the recording sheet may be informed through lighting of an alarm lamp, or information on the presence of the recording sheet may be displayed on the display panel of the image forming apparatus. Moreover, when the recording sheet remains in the sheet receiving tray 118, the image forming apparatus may be so configured as not to be restored to an enabled state because an error state cannot be resolved.

Figure 3:
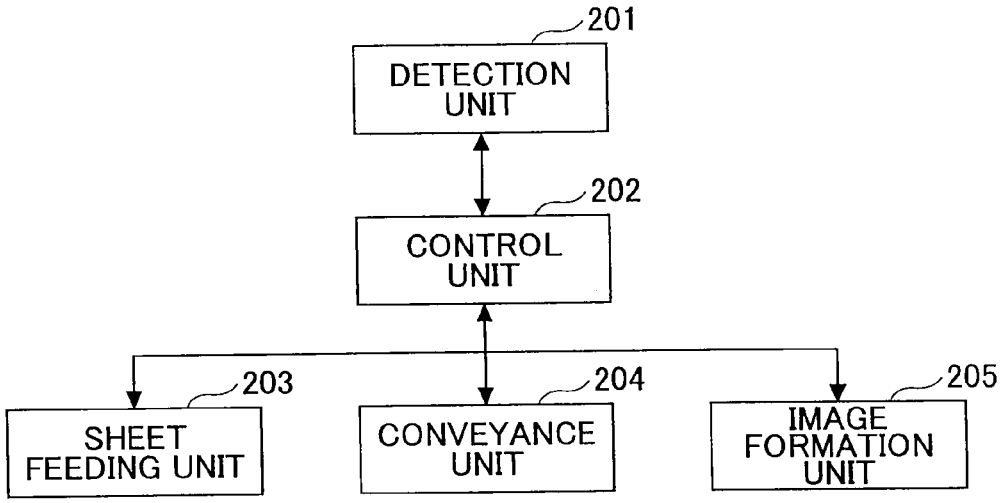
FIG. 3 is a function block diagram showing relationships between units of the image forming apparatus according to the embodiment of the present invention.

FIG. 3 is a function block diagram showing relationships between units of the image forming apparatus according to the embodiment of the present invention. A detection unit 201 is specifically composed of, for example, the sensors 113 through 117 and detects the conveyance status of the recording sheet. A control unit 202 is specifically a CPU not shown and controls the operations of the detection unit 201, a sheet feeding unit 203, a conveyance unit 204, and an image formation unit 205. The sheet feeding unit 203 is specifically composed of, for example, the sheet feeding tray 101 and the sheet feeding rollers 103 and feeds the recording sheet for image formation. The conveyance unit 204 is specifically composed of, for example, the conveyance rollers 106, the transfer rollers 107, etc., and conveys the recording sheet to perform an image formation process, such as printing and discharging, on the recording sheet in the image forming apparatus. The image formation unit 205 is specifically composed of, for example, the transfer belt 112, the fixation rollers 108, etc., and performs the image formation process on the recording sheet.

With the above configuration, the recording sheet fed from the sheet feeding trays 101 and 102 is conveyed on the conveyance path A with the conveyance rollers 106, the transfer rollers 107, etc., while being subjected to the image formation process. Then, the printed recording sheet is discharged to the sheet receiving tray 121. Furthermore, when double-sided printing is instructed by the user, the recording sheet is circulated on the conveyance path A via the double-sided printing path C with the control of the switching claws 119 and 122. The recording sheet is discharged after being subjected to rear-surface printing.

Figure 4:
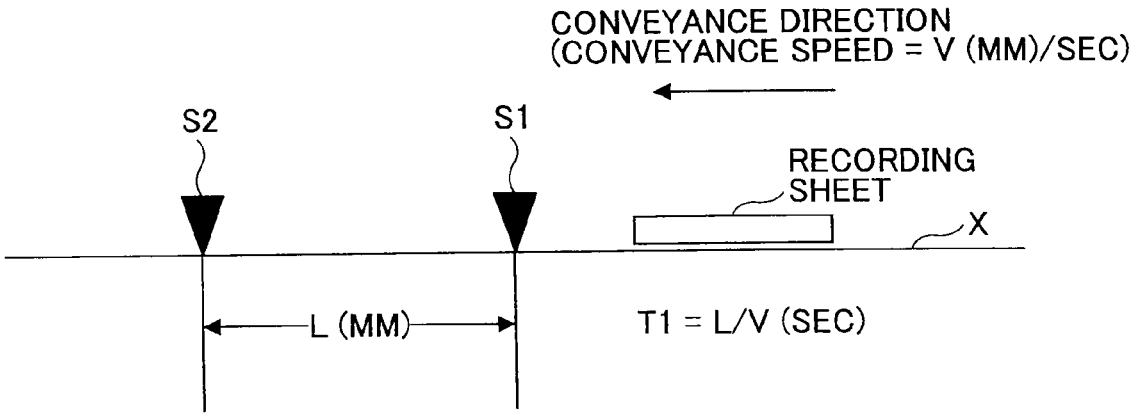
FIG. 4 is a schematic illustration of a part of a conveyance path for illustrating the unreached status of a recording sheet.
Figure 5:
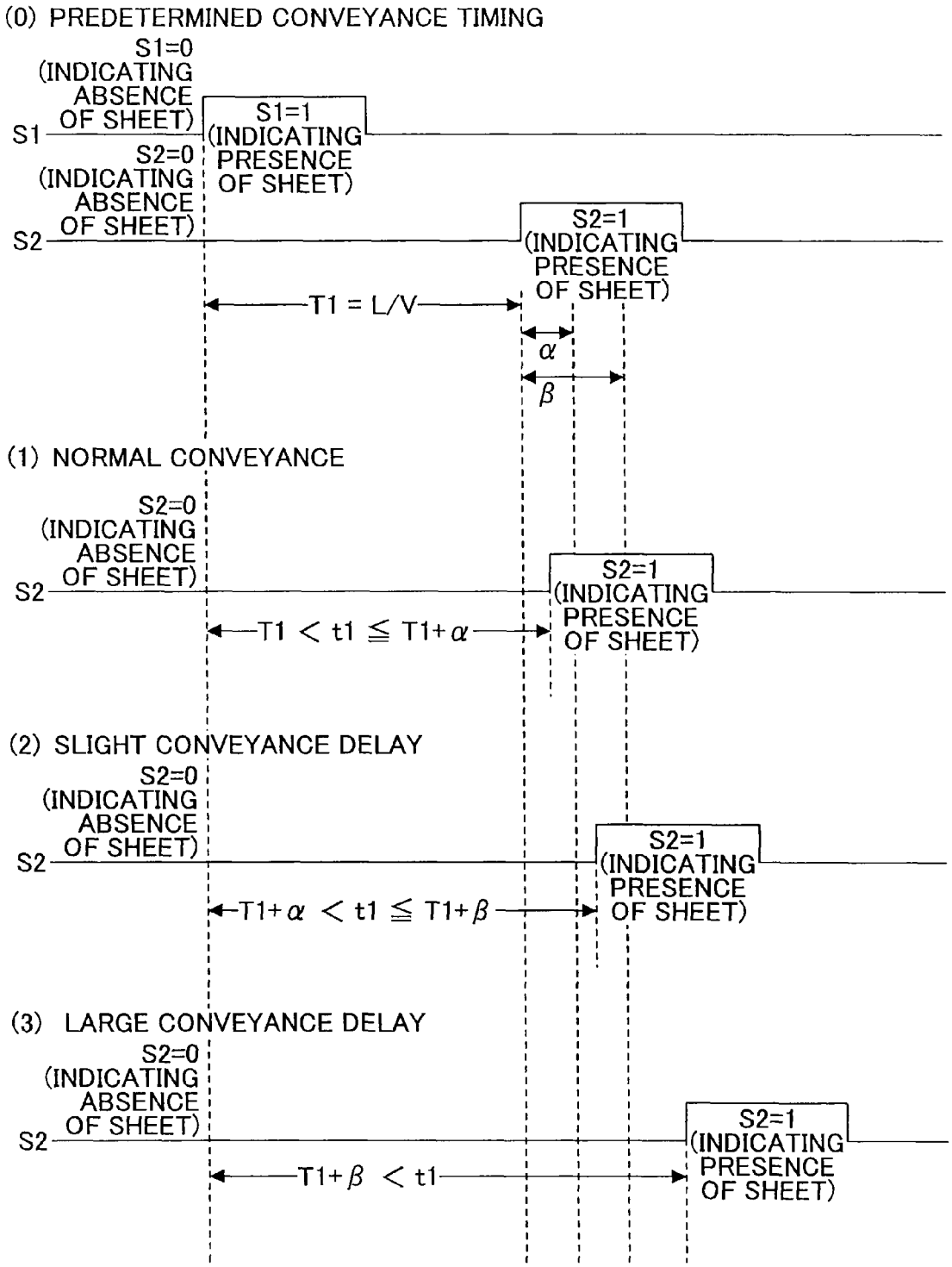
FIG. 5 is a timing chart for illustrating the detection statuses of the recording sheet with sensors S1 and S2.
Figure 6:
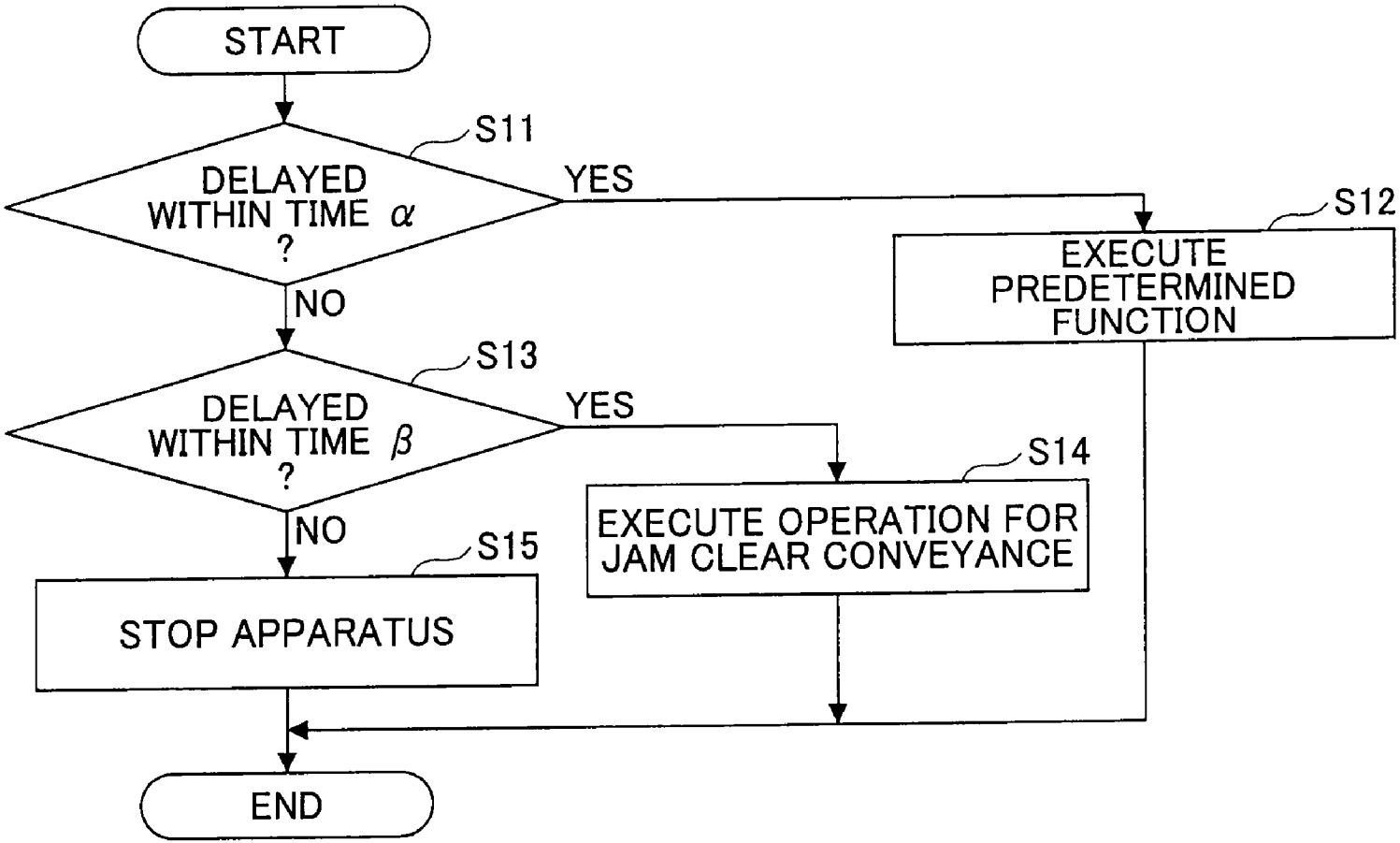
FIG. 6 is a flowchart showing processing based on the conveyance status of the recording sheet when the unreached status occurs.

Next, referring to FIGS. 4 through 6, a description is made of the situation of the unreached status and operations when the unreached status occurs.

FIG. 4 is a schematic illustration of a part of the conveyance path A; sensors S1 and S2 are disposed on a conveyance path X, and the recording sheet conveyed on the conveyance path X is successively detected with the sensors S1 and S2. The conveyance path X and the sensors S1 and S2 shown in FIG. 4 correspond to the conveyance path A and, for example, sensors 115 and 116 shown in FIG. 2, respectively.

Assuming that a distance between the sensors S1 and S2 is L (mm) and the conveyance speed of the recording sheet is V (mm/sec), the time required until the tip end of the recording sheet passes through the sensor S2 after having passed through the sensor S1 (i.e., the time required until the sensor S2 detects the tip end of the recording sheet after the sensor S1 has detected the tip end of the recording sheet, or the time required until the sensor S2 detects the presence of the recording sheet after the sensor S1 has detected the presence of the recording sheet) is L/V (sec). In the image forming apparatus, the time required until the tip end of the recording sheet passes through the sensor S2 after having passed through the sensor S1, T1=L/V (sec), is set in advance (referred to as predetermined conveyance timing in the following description). Therefore, when the time T1 is compared with timing t1 required when the conveyed recording sheet is actually detected with the sensor S2, the recording sheet is determined to be classified into any of the following statuses of (1) normal conveyance, (2) a minor conveyance delay, and (3) a major conveyance delay.

FIG. 5 is a timing chart for illustrating the detection statuses of the recording sheet with the sensors S1 and S2. The timing chart indicates the cases of (0) predetermined conveyance timing, (1) the normal conveyance, (2) a minor conveyance delay, and (3) a major conveyance delay in such a manner as to be compared with each other. Furthermore, FIG. 6 is a flowchart showing the subsequent processing for each of the above three conveyance statuses. Referring to FIGS. 5 and 6, a description is made of a method for controlling the image forming apparatus when the unreached status occurs. Note that the detection of the recording sheet and the control of the image forming apparatus based on the detection of the recording sheet are implemented with a CPU (Control Processing Unit) installed in the image forming apparatus.

(0) Predetermined Conveyance Timing

As shown in FIG. 5, when the recording sheet reaches the sensor S1 at the predetermined timing and the sensor S1 detects the tip end of the recording sheet, a detection signal S1 changes from "S1=0" (indicating the absence of the recording sheet) to "S1=1" (indicating the presence of the recording sheet). Similarly, when the recording sheet reaches the sensor S2 after having passed through the sensor S1, a detection signal S2 changes from "S2=0" (indicating the absence of the recording sheet) to "S2=1" (indicating the presence of the recording sheet). Furthermore, after the rear end of the recording sheet passes through the sensors S1 and S2, the respective detection signals return to 0 (indicating the absence of the recording sheet). As described above, the time from the rising of the signal S1 to the rising of the signal S2 is expressed by the formula T1=L/V. Furthermore, in FIG. 5, delay times $\alpha$ and $\beta$ since the rising of the signal S2 are shown.

(1) Normal Conveyance

As shown in FIG. 5, when the timing t1 for detecting the tip end of the recording sheet with the sensor S2 is delayed within the time $\alpha$ since the elapse of T1 (i.e., $T1<t1\leqq T1+\alpha$), the CPU determines that the recording sheet is being normally conveyed and controls the image forming apparatus to execute a predetermined function (Yes in S11 in FIG. 6→S12). Specifically, when the time $\alpha$ is, for example, 60 ms (i.e., $T1<t1\leqq T1+60$ ms), the CPU determines that the recording sheet is being normally conveyed and controls the image forming apparatus to execute, for example, a transfer function. Note that the recording sheet is frictionally conveyed. Therefore, if the conveyance of the recording sheet does not fall within the timing T1, the recording sheet is normally delayed in a conveyance direction. Thus, in order to make allowance for delays, it is actually preferable that the recording sheet be determined to be normally conveyed when $T1-\alpha\leqq t1\leqq T1+\alpha$ is met.

(2) Minor Conveyance Delay

As shown in FIG. 5, when the timing t1 for detecting the tip end of the recording sheet with the sensor S2 is greater than the time $\alpha$ and equal to or smaller than the time $\beta$ relative to T1 (i.e., $T1+\alpha<t1\leqq T1+\beta$), the CPU determines that a minor conveyance delay has occurred in the conveyance of the recording sheet, stops the feeding of the recording sheet from the sheet feeding tray 101 or 102, and executes a conveyance operation to discharge the recording sheet without executing the above predetermined function (Yes in S13 in FIG. 6→S14). Such a conveyance operation to discharge the recording sheet from the image forming apparatus is called "jam clear conveyance." Specifically, when the time $\beta$ is, for example, 120 ms (i.e., $T1+60\text{ ms}<t1\leqq T1+120$ ms), the CPU determines that a failure (minor conveyance delay) occurs in the conveyance of the recording sheet and continues the conveyance operation to discharge all the recording sheets remaining in the image forming apparatus without executing the following transfer function. In other words, if the failure in the conveyance of the recording sheet in the image forming apparatus is minor, jamming hardly occurs. Therefore, the above operation for discharging the recording sheet is performed so as to reduce the time required until the image forming apparatus is restored without stopping the apparatus.

(3) Major Conveyance Delay

As shown in FIG. 5, when the timing t1 for detecting the tip end of the recording sheet with the sensor S2 greatly exceeds the time $\beta$ relative to T1 (i.e., T1+<t1), the CPU determines that a major delay has occurred in the conveyance of the recording sheet and immediately stops the image forming apparatus (No in S13 in FIG. 6→S15). Specifically, when the time β is, for example, 120 ms (i.e., T1+120 ms<t1), the CPU determines that a major conveyance failure (major conveyance delay) has occurred in the conveyance of the recording sheet and stops the conveyance system of the image forming apparatus in addition to the inexecution of the subsequent transfer function. This is because when the major conveyance failure occurs in the image forming apparatus, the recording sheet may collide against the following recording sheet and the conveyance itself of the recording sheet may not be performed. If the conveyance of the recording sheet is continued in this state, jamming most likely occurs. In this example, the time β is set to 120 ms, but it may be determined based on whether the recording sheet causing the conveyance failure collides against the following recording sheet. That is, the time β may be set so as not to cause such a collision between the recording sheets. Note that a case in which the time β is infinite, i.e., a case in which the tip end of the recording sheet cannot be detected with the sensor S2 is also included. If such a major delay in the conveyance of the recording sheet occurs, the image forming apparatus is stopped. However, it is also possible to develop a system that restores the image forming apparatus to a status in which the recording sheet is slightly delayed in the conveyance. When the timing t1 is delayed for more than the time β relative to T1, the CPU determines that a major conveyance delay has occurred. However, if the delay time is close to the time β, the rotational speed of the conveyance rollers is increased so that the image forming apparatus can be restored to the status of (2) the "minor conveyance delay" with the sensor positioned behind the sensor that detects a major conveyance delay. In other words, even if the sensor S2 detects that the conveyance of the recording sheet is delayed for time (β+Δβ) relative to the predetermined timing T1, the rotational speed of the conveyance rollers for conveying the recording sheet is controlled to decrease the delay time to less than or equal to the time β. Thus, the image forming apparatus can be restored to the status of (2) the "minor conveyance delay." Therefore, it is possible to execute the operation for the jam clear conveyance without stopping the image forming apparatus. Note that the time Δβ can be appropriately set according to the characteristics of the conveyance rollers, etc. However, if the conveyance delay exceeds the time (β+Δβ), the image forming apparatus cannot be restored to the operation for the jam clear conveyance. In this case, the CPU determines that a major conveyance delay has occurred and stops the image forming apparatus.

Meanwhile, a collision between the recording sheets conveyed one after another depends on a relative positional relationship between the previously-conveyed recording sheet and the successively-conveyed recording sheet. That is, let it be assumed that the previously-conveyed recording sheet is delayed for 130 ms relative to predetermined detection timing, while the successively-conveyed recording sheet is delayed for 100 ms. In this case, it can be said that the previously-conveyed recording sheet is delayed for only 30 ms relative to the successively-conveyed recording sheet. As a result, these two recording sheets do not collide against each other. Therefore, in view of such a situation, the detection timing is corrected or the conveyance of the recording sheet is controlled in accordance with the detected statuses of the recording sheets with the sensors. Therefore, when it is determined that the previously-conveyed recording sheet and the successively-conveyed recording sheet do not collide against each other, it is further preferable that the control described in (2) the "minor conveyance delay" be made.

On the other hand, if a decrease in productivity can be allowed, a printing speed may be reduced instead of stopping the image forming apparatus. For example, when a special recording sheet not suitable for conveyance such as a coated paper is used, the conveyance failure is likely to be caused compared with a case in which the recording sheet suitable for conveyance is used. Therefore, settings on the rotational speed of the sheet feeding rollers and the conveyance rollers are changed so that the printing speed is reduced from, for example, 90 sheets per minute to 80 sheets per minute to decrease the number of the recording sheets circulating in the image forming apparatus. Thus, it is possible to expand a range within which the collision between the recording sheets is hardly caused and the operation for the jam clear conveyance can be executed. Specifically, in this case, the values of the times α and β are adjusted.

Although the above description refers to the unreached status, the accumulated status can be considered in the same manner. The unreached status is determined according to the timing for detecting the tip end of the recording sheet, but the accumulated status may be determined according to timings for detecting the tip end of the recording sheet and the rear end thereof. Next, a description is made of the situation of the accumulated status and operations when the accumulated status occurs.

Figure 7:
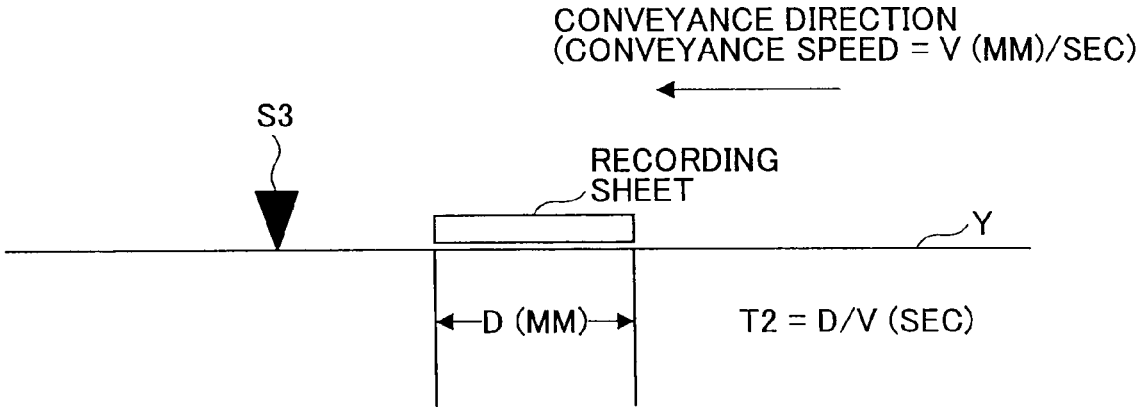
FIG. 7 is a schematic illustration of a part of the conveyance path for illustrating the accumulated status of the recording sheet.

FIG. 7 is a schematic illustration of a part of the conveyance path A; a sensor S3 is disposed on a conveyance path Y, and the recording sheet conveyed on the conveyance path Y is successively detected with the sensor S3. The conveyance path Y and the sensor S3 shown in FIG. 7 correspond to the conveyance path A and, for example, the sensor 116 shown in FIG. 2, respectively. Assuming that the length of the recording sheet in the conveyance direction is D (mm) and the conveyance speed of the recording sheet is V (mm/sec), the time required until the rear end of the recording sheet passes through the sensor S3 after the tip end of the recording sheet has passed through the sensor S3 (i.e., the time required until the sensor S3 detects the rear end of the recording sheet after having detected the tip end of the recording sheet, or the time required until the sensor S3 detects the presence of the recording sheet after having detected the presence of the recording sheet) is D/V (sec). In the image forming apparatus, the time required until the rear end of the recording sheet passes through the sensor S3 after the tip end of the recording sheet has passed through the sensor S3, T2=D/V (sec), is set in advance. Therefore, when the time T2 is compared with timing t2 required until the rear end of the conveyed recording sheet is actually detected with the sensor S3, the recording sheet is determined to be classified into any of the following statuses of (1) normal conveyance, (2) a minor conveyance delay, and (3) a major conveyance delay as in the case of the detection of the unreached status of the recording sheet.

Figure 8:
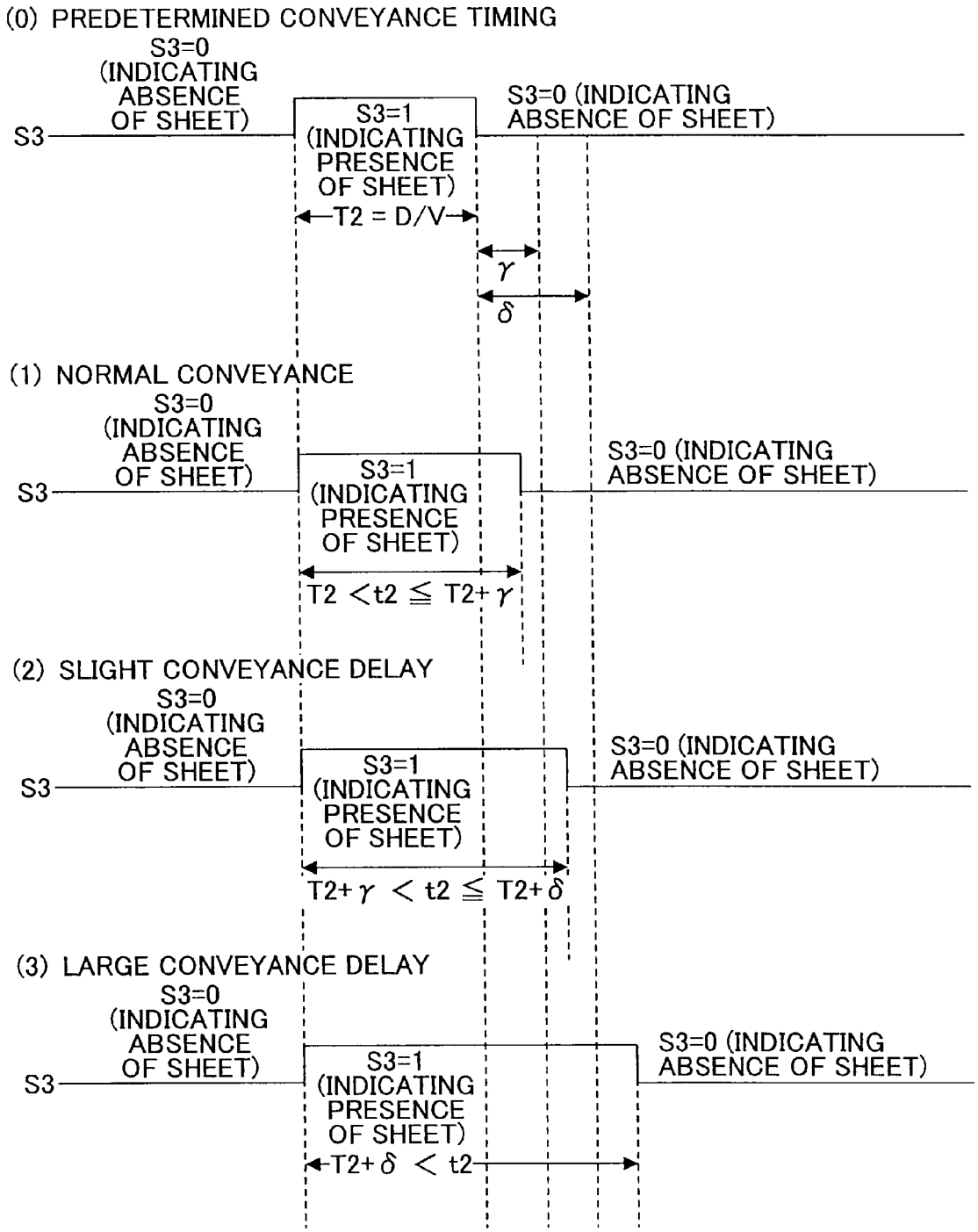
FIG. 8 is a timing chart for illustrating the detection statuses of the recording sheet with a sensor S3.
Figure 9:
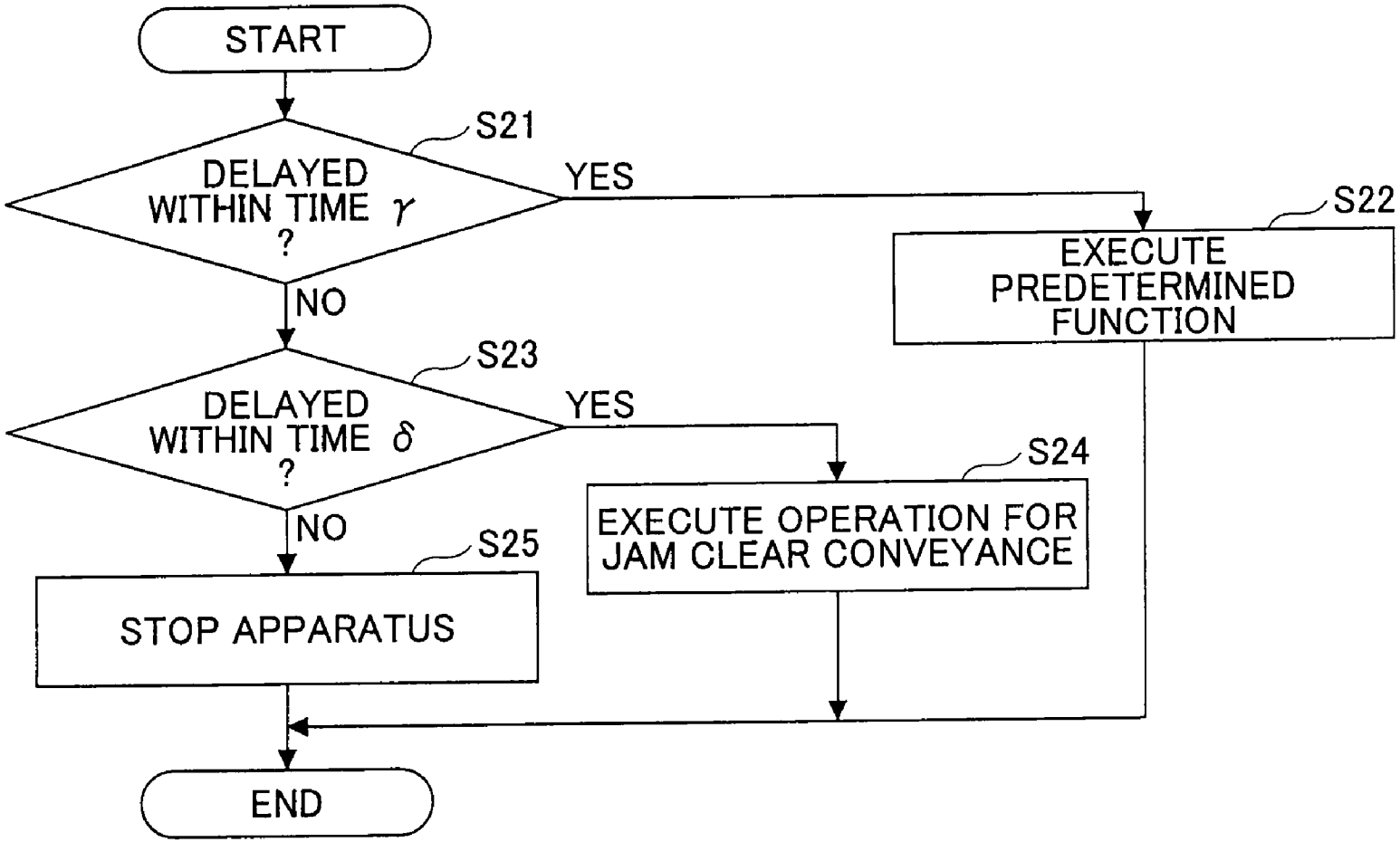
FIG. 9 is a flowchart showing processing based on the conveyance status of the recording sheet when the accumulated status occurs.

FIG. 8 is a timing chart for illustrating the detection statuses of the recording sheet with the sensor S3. The timing chart indicates the cases of (0) predetermined conveyance timing, (1) normal conveyance, (2) a minor conveyance delay, and (3) a major conveyance delay in such a manner as to be compared with each other. Furthermore, FIG. 9 is a flowchart showing the subsequent processing for each of the above three conveyance statuses. Referring to FIGS. 8 and 9, a description is made of a method for controlling the image forming apparatus based on detection results of the recording sheet when the accumulated status occurs.

(0) Predetermined Conveyance Timing

As shown in FIG. 8, when the recording sheet reaches the sensor S3 at the predetermined conveyance timing and the sensor S3 detects the tip end of the recording sheet, a detection signal S3 changes from "S3=0" (indicating the absence of the recording sheet) to "S3=1" (indicating the presence of the recording sheet). Then, when the rear end of the conveyed recording sheet passes through the sensor S3, the detection signal S3 changes from "S3=1" (indicating the presence of the recording sheet) to "S3=0" (indicating the absence of the recording sheet). As described above, the time from the rising of the signal S3 to the falling of the signal S3 is expressed by the formula T2=D/V. Furthermore, in FIG. 8, delay times γ and δ since the falling of the signal S3 are shown.

(1) Normal Conveyance

As shown FIG. 8, when the timing t2 for detecting the rear end of the recording sheet with the sensor S3 is delayed within the time γ since the elapse of T2 (i.e., $T2<t2\leqq T2+\gamma$), the CPU determines that the recording sheet is being normally conveyed and controls the image forming apparatus to execute a predetermined function (Yes in S21 in FIG. 9→S22). Specifically, when the time γ is, for example, 60 ms (i.e., $T2<t2\leqq T2+60$ ms), the CPU determines that the recording sheet is being normally conveyed and controls the image forming apparatus to execute, for example, a transfer function. FIG. 8 shows a state in which the rear end of the recording sheet is detected within the delay of the time γ since the elapse of T2 with the sensor S3.

(2) Minor Conveyance Delay

As shown in FIG. 8, when the timing t2 for detecting the rear end of the recording sheet with the sensor S3 is greater than the time γ and equal to or smaller than the time δ relative to T2 (i.e., $T2+\gamma<t2\leqq T2+\delta$), the CPU determines that a minor conveyance delay has occurred in the conveyance of the recording sheet, stops the feeding of the recording sheet from the sheet feeding tray 101 or 102, and executes the operation for the jam clear conveyance to discharge the recording sheet without executing the above predetermined function (Yes in S23 in FIG. 9→S24). Specifically, when the time δ is, for example, 120 ms (i.e., $T2+60\text{ ms}<t2\leqq T2+120\text{ ms}$), the CPU determines that a failure (minor conveyance delay) has occurred in the conveyance of the recording sheet and continues the conveyance operation to discharge all the recording sheets remaining in the image forming apparatus without executing the following transfer function. Such an operation is performed for the same reasons as in the case of the unreached status of the recording sheet. FIG. 8 shows a state in which the rear end of the recording sheet is detected within a delay greater than the time γ and smaller than or equal to the time δ relative to T2 with the sensor S3.

(3) Major Conveyance Delay

As shown in FIG. 8, when the timing t2 for detecting the rear end of the recording sheet with the sensor S3 greatly exceeds the time δ relative to T2 (i.e., $T2+\delta<t2$), the CPU determines that a major delay has occurred in the conveyance of the recording sheet and immediately stops the image forming apparatus (No in S23 in FIG. 9→S25). Specifically, when the time δ is, for example, 120 ms (i.e., $T2+120\text{ ms}<t2$), the CPU determines that a major conveyance failure has occurred in the conveyance of the recording sheet (major conveyance delay) and stops the conveyance system of the image forming apparatus in addition to the inexecution of the subsequent transfer function. Such an operation is performed for the same reasons as the case of the unreached status of the recording sheet. Based on whether the recording sheet causing the conveyance failure collides against the following recording sheet, the time δ may be appropriately set so as not to cause such a collision between the recording sheets. FIG. 8 shows a state in which the rear end of the recording sheet is detected to be delayed for a time greater than the time δ relative to T2 with the sensor S3. Note that a case in which the time δ is infinite, i.e., a case in which the rear end of the recording sheet cannot be detected with the sensor S3 must be included. Furthermore, as in the case of the unreached status of the recording sheet, the rotational speed of the conveyance rollers is controlled in case that a major conveyance delay occurs. Thus, the image forming apparatus can be restored to the status of (2) the "minor conveyance delay." Moreover, as in the case of the unreached status of the recording sheet, it is further preferable that the correction of the detection timing and the conveyance control be made based on whether the successively-conveyed recording sheets collide against each other, i.e., based on a relative positional relationship between the previously-conveyed recording sheet and the successively-conveyed recording sheet. In addition, as in the case of the unreached status of the recording sheet, the conveyance failure hardly occurs when the times γ and δ are adjusted.

In the above manner, the image forming apparatus according to the embodiment of the present invention detects the unreached status and the accumulated status and performs the operations corresponding to these statuses. However, the subject of the present invention is particularly directed to the case of (2) the "minor conveyance delay." As described above, when it is determined that the minor conveyance delay has occurred, the operation for the jam clear conveyance is executed. In this case, it is desired that all the recording sheets remaining in the image forming apparatus be accommodated in the sheet receiving tray with the operation for the jam clear conveyance. Therefore, the rollers of the conveyance system are driven only for the time required for the operation for the jam clear conveyance. For example, let it be assumed that a LCT (Large Capacity Tray) is connected to the image forming apparatus. Here, when the "minor conveyance delay" occurs in the recording sheet in the image forming apparatus immediately after the recording sheet is fed from the LCT, the rollers of the conveyance system may be driven only for the time until the recording sheet fed from the LCT is discharged to (reaches) a sheet receiving tray as a maximum period. In this case, the rollers of the conveyance system may be driven for, for example, four through five seconds from present technical standards.

Figure 10:
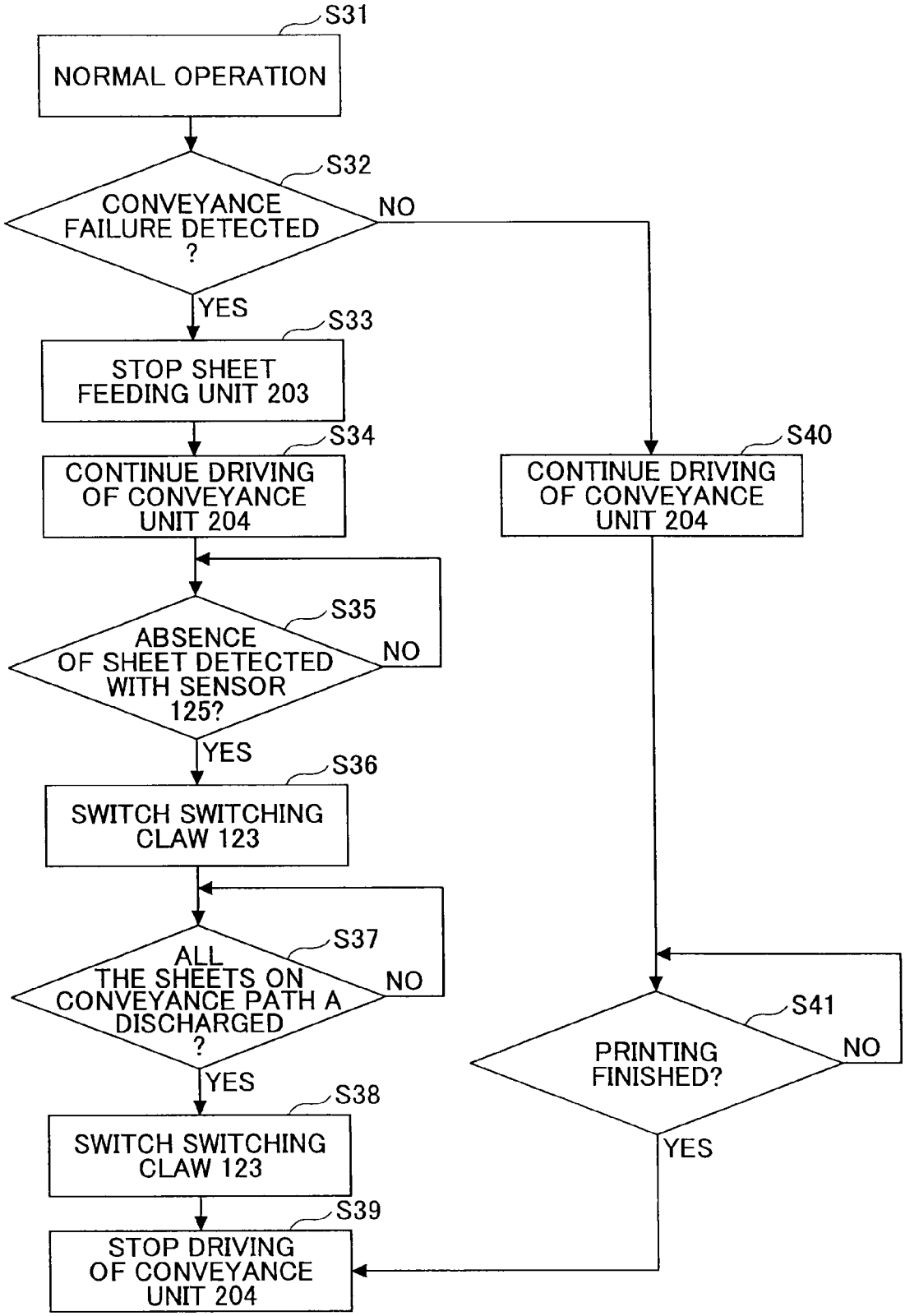
FIG. 10 is a flowchart for illustrating operations after a conveyance failure is detected.

Next, referring to FIGS. 10 and 11, a description is made of the entire operation of the image forming apparatus to which the operation for the jam clear conveyance is applied.

FIGS. 10 and 11 are a flowchart and a timing chart, respectively, for illustrating the operations until the recording sheet remaining in the image forming apparatus is discharged to the sheet receiving tray 118 after the unreached status and the accumulated status of the recording sheet are detected with the transfer timing sensor 116. In this example, the unreached status and the accumulated status are detected with the transfer timing sensor 116. However, the other sensors 113 through 115, 117, etc., other than the transfer timing sensor 116 have the function of detecting the unreached status and the accumulated status of the recording sheet. The arrangement and the number of the sensors may be appropriately selected, but they do not limit the embodiment of the present invention.

Figures 11A, 11B, 11C, 11D, 11E:
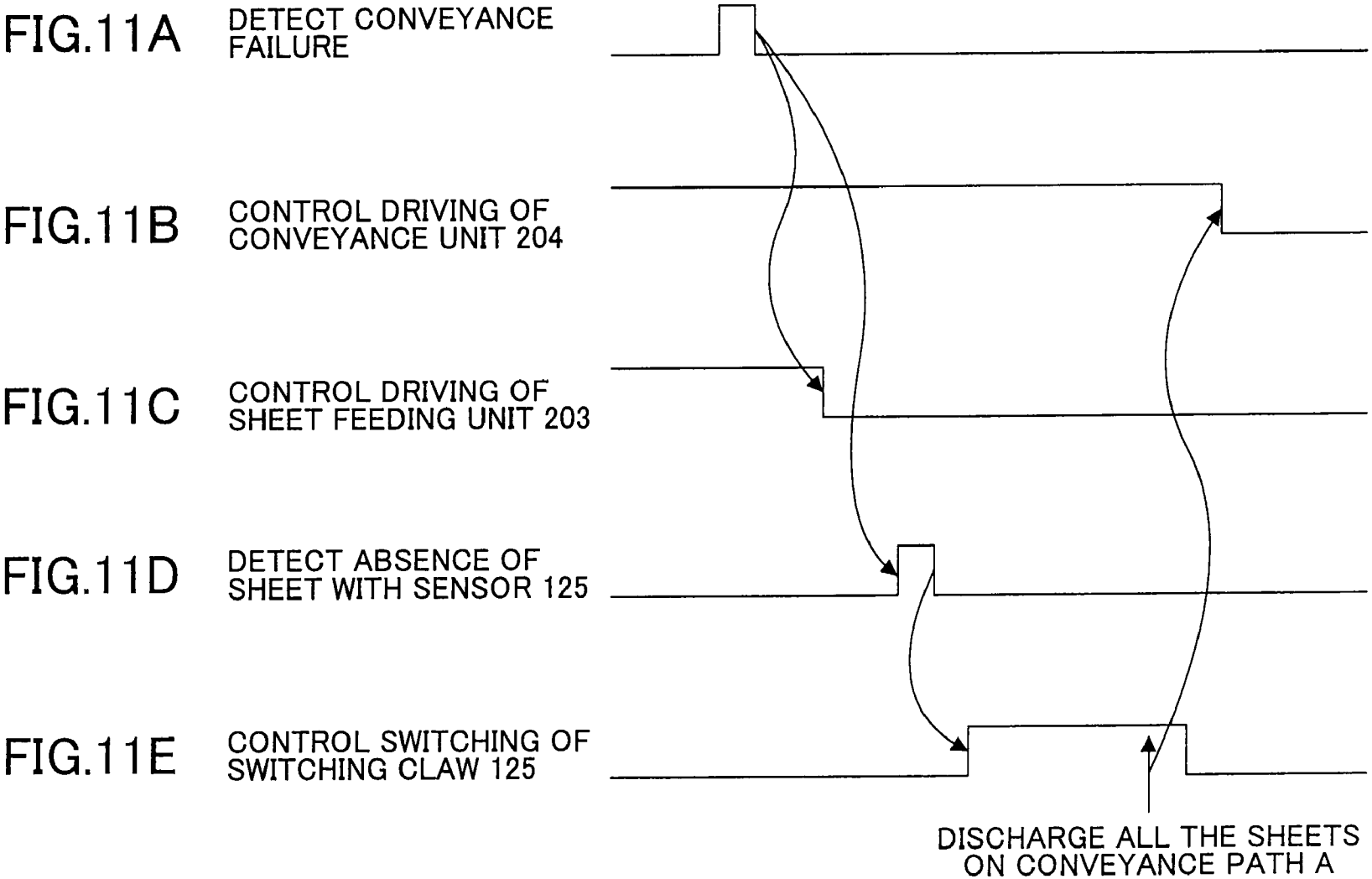
FIGS. 11A through 11E are timing charts for illustrating the operations after the conveyance failure is detected.

In FIG. 10, let it be assumed that the minor conveyance failure (unreached status) is detected with, for example, the transfer timing sensor 116 in a normal operation status (S31 in FIG. 10) (Yes in S32 in FIG. 11A). That is, it is assumed that the conveyance of the recording sheet is delayed for any reason and the tip end of the recording sheet does not reach the transfer timing sensor 116 at predetermined timing, which in turn causes the unreached status of the recording sheet. In this case, based on a signal from the transfer timing sensor 116 serving as the detection unit 201, conventional image forming apparatuses could be immediately stopped due to the conveyance failure. Conversely, the image forming apparatus according to the embodiment of the present invention stops the sheet feeding unit 203 with the control unit 202 and stops the feeding of a new recording sheet to the conveyance path A (S33 in FIG. 11C), while it continues the driving of the conveyance unit 204 (S34 in FIG. 11B).

Meanwhile, when the unreached status is detected with the transfer timing sensor 116, one of the plural recording sheets remaining in the image forming apparatus may be in a state of passing through near the switching claw 123. In this case, the switching claw 123 is controlled so that the conveyance direction of the recording sheet is switched to the side of the sheet discharging path E after the sensor 125 confirms that the recording sheet has passed through the switching claw 123. In other words, the control unit 202 monitors a signal from the sensor 125 based on a signal representing a conveyance failure from the transfer timing sensor 116. When the sensor 125 detects the absence of the recording sheet (Yes in S35 in FIG. 11D), the control unit 202 controls the switching claw 123 (S36) to switch the conveyance direction of the recording sheet from the side on the inversion path D for the normal operation of the image forming apparatus to the side of the sheet discharging path E. With the control of the switching claw 123, the recording sheet having passed through the flip rollers 110 is conveyed to the side of the conveyance path E, and then it naturally falls to be accommodated in the sheet receiving tray 118. When the control unit determines that all the recording sheets on the conveyance path A have been discharged by monitoring the various sensors 113 through 117, 125, etc., on the conveyance path A (Yes in S37), it controls the switching claw 123 again so that the conveyance direction is switched to the side of the inversion path D (S38 in FIG. 1E) and stops the driving of the conveyance unit 204 (S39 in FIG. 11B). Here, instead of determining the presence or absence of the recording sheet on the conveyance path A with the various sensors, the driving of the conveyance unit 204 may be stopped when a certain time has elapsed after the operation for the jam clear conveyance.

Moreover, the image forming apparatus notifies the user of the fact that the recording sheet is accommodated in the sheet receiving tray 118 through a lamp, etc., not shown. This notification may be visually performed through an alarm lamp not shown, the operations display panel, etc., of the image forming apparatus, or it may be performed through sound such as a beep tone. Such an operation is performed based on a detection signal from the recording sheet detection sensor 124 provided in the sheet receiving tray 118.

Note, however, that when no conveyance failure has occurred (No in S32), the image forming apparatus, of course, continues the driving of the conveyance unit 204 (S40) and stops the driving of the conveyance unit 204 (S39) after confirming the completion of a print job (Yes in S41).

Meanwhile, in the above control, the recording sheet is discharged without immediately stopping the image forming apparatus even if a minor conveyance delay occurs, i.e., even if the recording sheet may be jammed in the following steps. On the other hand, the image forming apparatus continues the driving of the conveyance system without determining whether the recording sheet is actually jammed like an accordion in the following steps. Accordingly, in a case in which the above LCT is connected to the image forming apparatus, damage may be increased when the image forming apparatus continues the conveyance of the rollers of the conveyance system for four through five seconds after having detected the unreached status of the recording sheet (the recording sheet may be jammed like an accordion because the conveyance system is driven for four through five seconds).

In order to deal with this problem, the image forming apparatus causes the respective sensors to continue the detection of the conveyance status of the recording sheet during the operation for the jam clear conveyance, which is described in detail below.

The detection of the minor conveyance delay that may cause the jamming is called first conveyance failure detection for the sake of convenience. Upon detecting the first conveyance failure, the image forming apparatus starts the operation for the jam clear conveyance. After the operation for the jam clear conveyance, the image forming apparatus causes the respective sensors to continue the detection of the conveyance status of the recording sheet and monitor whether the unreached status and the accumulated status of the recording sheet occur, which is called second conveyance failure detection. The second conveyance failure detection can be performed in the same manner as the detection for the unreached status and the accumulated status of the recording sheet as described above. In the case of the second conveyance failure detection, it is assumed that the recording sheet may be most likely jammed like an accordion, which causes great damage (or which actually causes damage). Therefore, the image forming apparatus is immediately stopped so as to minimize the damage.

In the above control, an error code regarding the first conveyance failure detection (i.e., the code indicating what type of conveyance failure has occurred) is displayed on a display panel, while an error code regarding the second conveyance failure is not displayed on it. This is because the recording sheet to be detected as the one causing the second conveyance failure detection is not a normally-conveyed recording sheet. That is, it is important for the user to recognize only the recording sheet that causes the first conveyance failure. In this case, if the user is allowed to see the place of the recording sheet remaining in the image forming apparatus through the alarm lamp, he/she can recognize the type of the first conveyance failure without having any trouble and uses such information, for example, for repairing the image forming apparatus.

As described above, when the conveyance failure occurs, all the recording sheets on the conveyance path A are accommodated in the sheet receiving tray 118. Therefore, the user can restore the image forming apparatus to a normal operation status only by removing the recording sheet from the sheet receiving tray 118.

Note that in the embodiment of the present invention, all the recording sheets on the conveyance path A are accommodated in the sheet receiving tray 118. However, a sheet discharging path having the same function as the sheet discharging path E may be provided on the midstream of the conveyance path A as one of the accommodation units to receive the recording sheet in cooperation with the sheet receiving tray 118. Alternatively, an ejection part for the recording sheet may be provided on the conveyance path A instead of the accommodation unit so that the recording sheet is ejected to the plural accommodation places including the sheet receiving tray 118. Note that in the above cases, they should be arranged for the sake of convenience so that the user can easily restore the image forming apparatus.

The above description refers to the case of the unreached status. However, even in the case of the accumulated status, the recording sheet remaining in the image forming apparatus can be accommodated in the sheet receiving tray 118 in the same manner.

As described above, according to the embodiment of the present invention, when the recording sheet is conveyed within the predetermined period even if such the conveyance failures as the unreached status and the accumulated status occur, the image forming apparatus continues the driving of the conveyance units so as to remove the recording sheet remaining on the conveyance path A. Therefore, even if the unreached status and the accumulated status are caused, the user can restore the image forming apparatus easily and promptly only by removing the recording sheet from the sheet receiving tray 118 and implement a series of printing operations in a short period of time as a whole.

The present invention is not limited to the specifically disclosed embodiments, and variations and modifications may be made without departing from the scope of the present invention.

The present application is based on Japanese Priority Application No. 2008-157007 filed on Jun. 16, 2008 and Japanese Priority Application No. 2008-227989 filed on Sep. 5, 2008, the entire contents of which are hereby incorporated herein by reference.

What is claimed is:

1. An image forming apparatus comprising:

a recording medium feeding unit that feeds a recording medium to a predetermined conveyance path;

a conveyance unit that conveys the recording medium fed from the recording medium feeding unit on the conveyance path;

a conveyance status detection unit that detects a conveyance status of the recording medium placed on the conveyance path;

a control unit that controls operations of the recording medium feeding unit, the conveyance unit, and the conveyance status detection unit; and an accommodation unit that accommodates the recording medium, wherein in response to detecting a delay in the conveyance of the recording medium with the conveyance status detection unit, the control unit stops the feeding of another recording medium with the recording medium feeding unit while continuing the conveyance of the recording medium already present with the conveyance unit only for a predetermined period, and wherein the predetermined period is set to a period required for discharging the recording medium present in the image forming apparatus to the accommodation unit.

2. The image forming apparatus according to claim 1, further comprising:

a display unit on which the detection result of the conveyance status detection unit is displayed.

3. The image forming apparatus according to claim 2, wherein the detection result of the conveyance status detection unit indicates a type of a conveyance failure.

4. The image forming apparatus according to claim 1, wherein, when detecting another delay in the conveyance of the recording medium already present with the conveyance status detection unit during the predetermined period in which the conveyance of the recording medium is continued, the control unit stops the conveyance unit.

5. The image forming apparatus according to claim 1, wherein the conveyance path is annularly-shaped, a recording medium inversion unit is provided on the conveyance path, and the recording medium is inverted with the recording medium inversion unit and conveyed so as to be subjected to double-sided printing.

6. The image forming apparatus according to claim 1, wherein the control unit controls the feeding of the recording medium with the recording medium feeding unit and the conveyance of the recording medium with the conveyance unit based on a detection result of the conveyance status detection unit, thereby discharging the recording medium present in the image forming apparatus to the accommodation unit.

7. An image forming apparatus comprising:

a recording medium feeding unit that feeds a recording medium to a predetermined conveyance path;

a conveyance unit that conveys the recording medium fed from the recording medium feeding unit on the conveyance path;

a conveyance status detection unit that detects a conveyance status of the recording medium placed on the conveyance path;

a control unit that controls operations of the recording medium feeding unit, the conveyance unit, and the conveyance status detection unit; and an accommodation unit that accommodates the recording medium, wherein in response to detecting a delay in the conveyance of the recording medium with the conveyance status detection unit and that a distance between the recording medium causing the delay in the conveyance and a subsequent recording medium is larger than a predetermined distance, the control unit stops the feeding of another recording medium with the recording medium feeding unit while continuing the conveyance of the recording medium already present with the conveyance unit only for a predetermined period.

8. The image forming apparatus according to claim 7, wherein the control unit controls the feeding of the recording medium with the recording medium feeding unit and the conveyance of the recording medium with the conveyance unit based on a detection result of the conveyance status detection unit, thereby discharging the recording medium present in the image forming apparatus to the accommodation unit.

* * * * *